United States Patent [19]

Bubik et al.

[11] 4,361,467

[45] Nov. 30, 1982

[54] HEADBOX FOR A PAPERMAKING MACHINE

[75] Inventors: Alfred Bubik; Hans Dahl, both of Ravensburg; Rüdiger Kurtz, Immenstaad, all of Fed. Rep. of Germany

[73] Assignee: Escher Wyss GmbH, Ravensburg, Fed. Rep. of Germany

[21] Appl. No.: 322,020

[22] Filed: Nov. 16, 1981

[30] Foreign Application Priority Data

Dec. 19, 1980 [CH] Switzerland ..... 9392/80

[51] Int. Cl.[3] ..... D21F 1/00

[52] U.S. Cl. ..... 162/336; 162/317; 162/344; 162/347

[58] Field of Search ..... 162/317, 336, 344, 347

[56] References Cited

U.S. PATENT DOCUMENTS

| | | | |
|---|---|---|---|
| 4,021,296 | 5/1977 | Reiner | 162/344 |
| 4,125,429 | 11/1978 | Hergert et al. | 162/344 |
| 4,133,713 | 1/1979 | Chuang | 162/347 |
| 4,280,870 | 7/1981 | Bubik et al. | 162/347 |

*Primary Examiner*—Peter Chin

*Attorney, Agent, or Firm*—Werner W. Kleeman

[57] ABSTRACT

A headbox contains a rigid lower lip which is directed towards a dewatering surface, a wire or the like, guided over a rotating cylinder or roll, and a rigid upper lip having a rigid lip portion which, in conjunction with a portion or section of the dewatering surface neighboring the lower lip downstream with respect to the flow of the stock suspension, delimits a sheet forming chamber or space. The lip portion is provided at the region of the sheet forming chamber with step or groove-like depressions or recesses extending transversely with respect to the direction of flow of the stock or fiber suspension. These recesses serve to form recirculation turbulence which supports the marginal flow of the stock suspension. With this arrangement the effect of the wall friction upon the flow velocity is practically eliminated, so that with a flow velocity of the stock suspension which is adjusted in accordance with the travel speed of the dewatering surface, there is ensured for a uniform forming of the suspended fibers of the stock suspension in the lengthwise and transverse direction of the paper which is to be fabricated.

10 Claims, 8 Drawing Figures

HEADBOX FOR A PAPERMAKING MACHINE

CROSS REFERENCE TO RELATED CASE

This application is related to the commonly assigned, copending U.S. application Ser. No. 06/321,676, filed Nov. 16, 1981, entitled "HEADBOX FOR A PAPERMAKING MACHINE", and listing as the inventor Rüdiger Kurtz.

BACKGROUND OF THE INVENTION

The present invention relates to a new and improved construction of headbox for a papermaking machine.

Generally speaking, the headbox for a papermaking machine of the present development is of the type comprising an infeed channel for the stock suspension at which merges a nozzle channel bounded by two substantially rigid lips or lip members. These lip members are oriented towards a substantially band-shaped dewatering surface guided over a rotating water pervious or foraminous roll or cylinder. The first lip member possesses an end intended to approach the dewatering surface and the second lip member possesses a rigid lip portion which protrudes past the end of the first lip member in the flow direction of the stock suspension. This rigid lip portion is provided with a guide surface which is concave with respect to the stock suspension. This concave guide surface covers a portion of the dewatering surface neighboring the end of the first lip member in the downstream direction thereof and by means of such portion delimits a sheet forming chamber or space which converges in the direction of movement of the dewatering surface.

According to a heretofore known apparatus of this type the first lip member and the lip portion of the second lip member are guided at a portion of a wire or sieve forming the dewatering surface. This wire portion extends over part of the circumference of a suction breast roll. The first lip member and the lip portion of the second lip member each possess an inner surface which is smooth over its entire length. Significant in this regard is the headbox construction disclosed in U.S. Pat. No. 4,133,713, granted Jan. 9, 1979. With this type of design of headbox there can be observed a reduction of the flow velocity which is caused by wall friction. This reduced flow velocity appears at the outer marginal region of the flow extending along the second lip member. Consequently, the stock fibers dispersed in the stock suspension, particularly when encountering higher flow or machine velocities, tend to increasingly orient in the flow direction. As a result, the tear or breaking strength of the paper which is to be fabricated can be impaired in a direction transversely with respect to the flow direction and the travel direction of the dewatering surface, respectively.

According to another state-of-the-art construction of a similar type, as disclosed in U.S. Pat. No. 4,125,429, granted Nov. 14, 1978, the second lip member is provided with a flexible wall portion which covers the sheet forming chamber or space. This flexible wall portion snugly adapts itself to the flow of the stock suspension. From this prior art reference it is also known, but in a different connection, i.e. for the purpose of preventing the clumping together or agglomeration of the stock fibers, to equip the flexible wall portion with turbulence generators. However, these turbulence generators cause a pronounced directional change in the marginal flow, and thus, can lead to the formation of lengthwise turbulence pairs which appear in the form of lengthwise streaks in the paper which is fabricated. Also with this prior art construction there can arise the previously described drawbacks caused by the wall friction at the marginal flow extending along the flexible wall portion.

Other constructions of headbox are known to the art, such as for instance typified by U.S. Pat. No. 4,280,870, granted July 28, 1981 which use step-shaped widened portions within the guide channel for the stock suspension and an adjustable lip for regulating the size of the outlet opening or slice.

SUMMARY OF THE INVENTION

It is a primary object of the present invention to improve upon the headbox constructions of the prior art, and specifically, to provide a new and improved construction of headbox for a papermaking machine wherein there can be obtained as uniform as possible flow velocity over the entire cross-section of the sheet forming chamber or area, and thus, also when encountering high flow or machine velocities there can be realized a uniform forming of the stock fibers in the lengthwise and transverse direction of the paper which is to be fabricated.

Another important object of the present invention aims at providing a new and improved construction of headbox for a papermaking machine which is relatively simple in construction and design, economical to manufacture, extremely reliable in operation, not readily subject to breakdown or malfunction, and requires a minimum of maintenance and servicing.

Still a further significant object of the present invention is directed to a new and improved construction of headbox for a papermaking machine which affords relatively constant flow velocities of the stock suspension over the entire cross-sectional area of the sheet forming chamber or space and attains a relatively uniform deposition or formation of the stock fibers in the lengthwise and transverse direction of the fabricated paper.

Now in order to implement these and still further objects of the invention, which will become more readily apparent as the description proceeds, the headbox of the present development is manifested by the features that the lip portion, at least at the upstream half of the part of its guide surface which overlies or covers the dewatering surface, possesses at least one step-like recess which extends transversely with respect to the flow direction of the stock suspension. This step-like recess or depression is formed by at least one base surface which is offset in relation to the guide surface and extends essentially in the flow direction of the stock suspension, and further contains a flank or flank portion which is disposed transversely with respect to the flow direction of the stock suspension. This flank portion is oriented at least approximately at right angles or perpendicular to the guide surface.

By virtue of the inventive construction of the lip portion which overlies the sheet forming chamber or area there is formed a recirculation turbulence at the region of the recess or depression. This recirculation turbulence supports the marginal flow of the stock suspension which extends along the lip portion, so that there can be beneficially reduced the effect of the wall friction upon the marginal region of the velocity profile extending over the cross-section of the sheet forming chamber or area. Consequently, at least at the portion of the sheet forming chamber or area which merges downstream of the recess there is avoided a reduction of the flow velocity at the marginal or boundary region.

The headbox of the present development ensures, through the use of most simple and economical means, orientation of the fibers in as uniform manner as possible. Consequently, the advantages of the invention can be realized with very little equipment expenditure also, for instance, at papermaking installations containing existing suction formers or suction breast roll formers in that, for instance, the existing lip portion having a smooth inner surface can be replaced by a lip portion constructed according to the invention or can be converted or modified in accordance with the teachings of the invention by appropriately reworking of fabricating such lip portion. Since there is practically dispensed with the problem of orientation of the fibers which arise with the heretofore known papermaking installations at the sheet forming area, the inventive construction of headbox enables processing of stock suspensions containing a greater stock density than was heretofore possible.

The flank of the recess or depression can be formed at a raised portion or protuberance which protrudes from a portion of the inner surface of the lip portion extending in the flow direction of the stock suspension, this protuberance projecting into the sheet forming chamber or area. With this construction there can be converted an existing headbox in a particularly simple manner in that the protuberance can be attached, for instance, in the form of a ledge-shaped mountable part at the smooth inner surface of a lip portion of the heretofore known construction of the prior art.

The part of the guide surface which covers the dewatering surface can possess three to approximately twenty recesses or depressions which are arranged in succession in the flow direction of the stock suspension. In this way the effect of the wall friction can be practically eliminated throughout the entire region of the sheet forming area. Consequently, there can be produced over the height of the throughflow cross-section of the sheet forming area or chamber an almost constant, i.e., approximately rectangular-shaped velocity profile or curve, so that the stock suspension departs with practically the same flow velocity at the end region of the lip portion of the second lip member and at the end region of the first lip member. Hence, it is possible to effectively prevent, by appropriately setting the flow velocity in accordance with the travel speed of the dewatering surface, a so-to-speak "flipping over" of the stock fibers in the flow direction at the sheet forming region.

The invention further contemplates delimiting the flanks of the recesses or depressions at their sides confronting the dewatering surface by edges located at the region of the guide surface. By virtue of the guide surface which is defined by the edges of the flanks there is realized a merely theoretical boundary for the marginal flow which rolls upon the recirculation turbulence.

According to a further construction of the inventive headbox there may be provided at least one substantially lip-shaped intermediate wall which protrudes through the outlet gap or slice into the sheet forming area or chamber. This lip-shaped intermediate wall extends in accordance with the main flow direction of the stock suspension. This intermediate wall is provided at a portion located between the lip portion and the dewatering surface with at least one recess corresponding to the neighboring recess of the lip portion. This construction of headbox enables reducing the wall friction also, for instance, within the so-called multiply headboxes, where as is well known two or more different types of stock suspensions are infed to the forming region in different plies or layers, each separated from one another by a respective intermediate wall. By virtue of the recess provided at the intermediate wall there can be particularly precluded the formation of a boundary layer between the relevant stock plies or layers. A further advantage of this headbox design resides in the features that the outlet gap or slice needed for obtaining a predetermined ply thickness, for instance in order to realize the requisite thickness of the part of the intermediate wall bounding the recess, can be wider than with the heretofore known prior art designs, since the thickness of the flowing plies or layers separated from one another by the intermediate wall is limited by the theoretical guide surfaces of the lip portion extending over the recesses and the intermediate wall. This modified construction of headbox therefore requires a correspondingly less precise adjustment or setting than the heretofore known prior art constructions of headboxes.

The intermediate wall can be attached to a holder or support arranged neighboring the slice or outlet gap. This allows for a particularly simple installation and dismantling of the intermediate wall and particularly also facilitates the inspection and possible maintenance of the holder or support.

Furthermore, the recess can be connected to a device for the infeed of a flow medium which can be introduced independent of the primary flow of the stock suspension. With this design there is possible the addition of additives and/or a selective intensification of the recirculation flow governed by the geometry of the recess or depression, which thus can be easily accommodated in a most simple manner also to fluctuating flow conditions.

Moreover, the recess can possess a substantially groove-shaped cross-sectional configuration which is formed by the base surface and two confronting flanks. The base surface encloses with the flow upstream flank an at least approximately right angle and with the flow downstream flank an angle which is at least approximately a right angle or an obtuse angle. This recess configuration is particularly suitable for the formation of the microturbulence needed for the inventive guiding of the marginal flow. The sudden widening of the flow cross-section, formed by the flow upstream flank of the recess or depression, is particularly advantageous for the formation of the recirculation turbulence, whereas the shape or form of the flow downstream flank of the recess determines the propogation of the turbulence.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
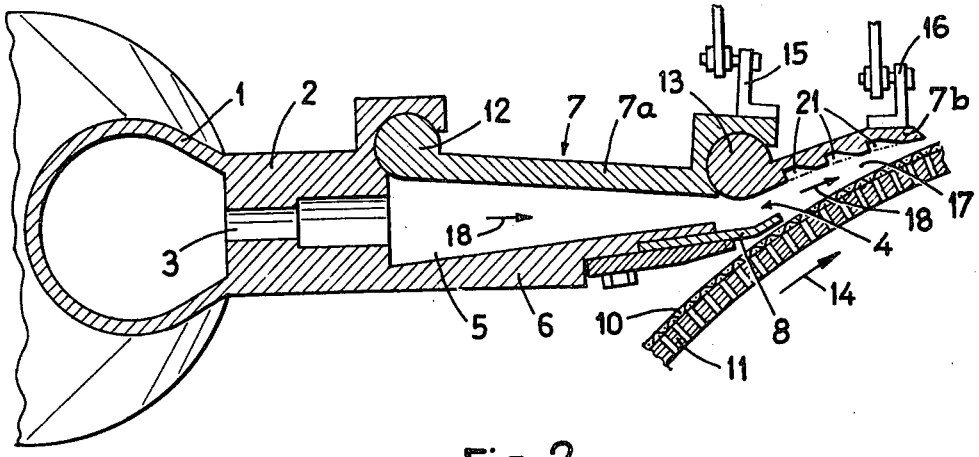
FIG. 1 illustrates a headbox in partial cross-sectional view and constructed according to the invention.

Describing now the drawings, it is to be understood that throughout the various Figures thereof only enough of the construction of the headbox for a papermaking machine has been shown, to simplify the illustration, and as will enable those skilled in the art to readily understand the underlying principles and concepts of the present development. Turning attention now to the exemplary embodiment of headbox shown in FIG. 1 it will be seen that the same contains a manifold or distributor line 1 which is connected with a here not further illustrated, but conventional infeed conduit or line for the fiber or stock suspension. Laterally merging with the manifold or distributor line 1 is a guide device 2 possessing substantially cylindrical, step-shaped enlarged throughflow openings 3. A manifold or distributor line suitable for use with the headbox of the present invention and which does not constitute subject matter of the instant development has been disclosed, for instance, in German Pat. No. 2,607,823 and the corresponding U.S. Pat. No. 4,087,321, granted May 2, 1978.

Merging with the guide device 2 is a nozzle channel 5 which converges towards an outlet gap or slice 4. This nozzle channel 5 is bounded by a stationary rigid lower lip 6 and an adjustable, rigid upper lip 7 which can be selectively positionally oriented for the purpose of adjusting the cross-section or cross-sectional area of the nozzle channel 5. The lower lip or lip member 6 contains a rigid plate member 8 which is adjustably secured at its tip or trailing end for movement in its lengthwise direction. This adjustably mounted rigid plate member 8 leads towards a wire or sieve 10 which is guided over a wire or sieve cylinder 11 of a here not further illustrated sheet forming device or sheet former of a papermaking machine as is well known in this technology. The upper lip or lip member 7 consists of two relatively adjustable lip portions or parts 7*a* and 7*b* which, in conventional manner, are pivotably connected with the guide device 2 and with the tip of the lip portion 7*a*, respectively. Each of these lip portions 7*a* and 7*b* is pivotable about the axis of a related cylindrical part 12 and 13, respectively. The lip portions 7*a* and 7*b* each can be adjusted in relation to the lower lip 6 and relative to the portion of the wire of sieve 10 merging with the sieve cylinder in the circumferential direction thereof, as indicated by the arrow 14, by means of an adjustment rod 15 and 16, respectively, each of these adjustment rods 15 and 16 being operatively connected with a here not further illustrated but conventional adjustment device.

By means of the adjustment rods 15 and 16 it is possible to adjust in known manner the flow cross-section of the nozzle channel 5 and the width of the outlet gap or slice 4 and the cross-section of a sheet forming chamber or area 17 which converges in approximately sickle-shaped fashion in the circumferential direction of the wire 10, as indicated by the arrow 14, and formed by the region of the wire 10 which is covered by the lip portion 7*b*.

During operation of the equipment, a stock or fiber suspension is infed to the headbox by means of the manifold or distributor line 1. This stock suspension is uniformly distributed by the throughflow openings 3 over the width of the nozzle or guide channel 5 for the stock suspension as measured perpendicular to the plane of the drawing in FIG. 1. As indicated by the arrow 18 the infed stock suspension is delivered through the slice or outlet gap 4 to the sheet forming chamber or area 17. At this sheet forming area 17 the fibers suspended in the stock suspension are deposited upon the dewatering surface formed by the wire or sieve 10, whereas the water is withdrawn through the not particularly referenced bores or holes of the wire cylinder 11.

Figure 2:
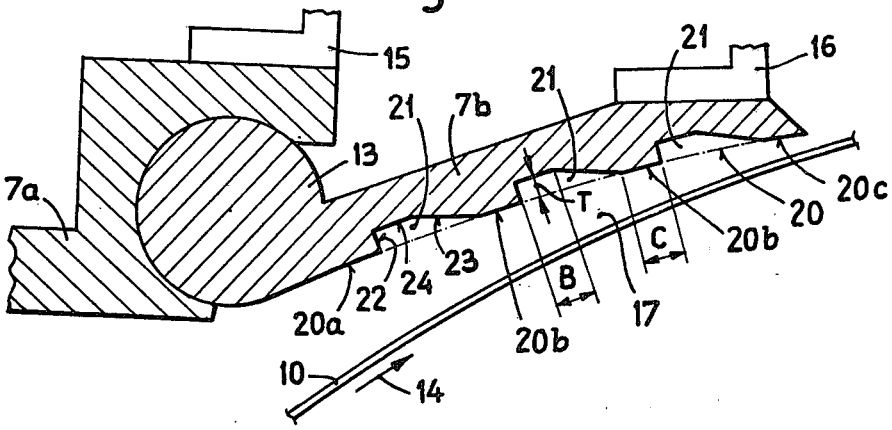
FIG. 2 illustrates on an enlarged scale details of the headbox of FIG. 1.

As particularly evident by referring to FIG. 2, the inner surface of the lip portion 7*b*, which confronts the wire or sieve 10, is provided with substantially groove-shaped depressions or recesses 21. These depressions or recesses 21 are disposed in succession with respect to the flow direction of the stock suspension 18 and extend transversely to such flow direction. Each of these recesses or depressions 21 possesses a substantially trapezoidal-shaped cross-sectional configuration which is formed by two flanks or flank portions 22, 23 and a base surface 24. The flow upstream flanks 22 of the recesses or depressions 21 are each oriented at an approximately right angle to the portions 20*a* and 20*b*, as the case may be, of the inner surface and which neighbor the flanks in the flow upstream direction. These flanks 22 of the recesses 21 are also disposed essentially at right angles to the base surface 24 which encloses with the flow downstream flank 23 an obtuse angle. The recesses 21 each possess a depth T and a width B measured at the base surface 24 in the direction of flow of the stock suspension. The width B is approximately equal to or larger than the depth T. This depth T can amount to as much as approximately 20 mm, for instance can be about 2.5 mm. The recesses 21 are separated from one another by the surface portions 20*b*, the width C of which, measured in the flow direction 18 of the stock suspension, corresponds approximately to the width B. The surface portions 20*a* and 20*b* and a surface portion 20*c* merging at the last recess or depression 21 at the flow downstream side, are located in a slightly curved reference surface which is defined by the circumference of the wire cylinder 11. This reference surface constitutes an effective outer guide surface 20 for the flow and has been shown in phantom lines in the drawing of FIG. 2.

At the region of each of the recesses or depressions 21 there is formed recirculation turbulence upon which there so-to-speak "rolls off" the marginal flow of the stock suspension which is practically bounded by the guide surface 20 of the lip portion or part 7*b*. Consequently, at the region of the lip portion 7*b* the velocity losses caused by the wall friction become negligibly small and the flow therefore possess an approximately rectangular-shaped velocity profile or curve which uniformly extends over the height of the sheet forming area or chamber 17. With the lip portions 7*a* and 7*b* appropriately positionally adjusted and with a correspondingly accommodated stock suspension infeed the stock suspension at the end region of the lip portion 7*b* and at the end region of the plate member 8 flows out practically with the same flow velocity which is accommodated to the peripheral velocity of the wire or sieve 10. Consequently, there is prevented a flipping over of the fibers suspended in the stock suspension in the flow direction, something which was possible with prior art headboxes of the this type due to the velocity difference between the marginal flow and the wire 10, and additionally, there is ensured for a uniform orientation of the fibers in the lengthwise and transverse direction of the paper which is to be fabricated.

Figure 3:
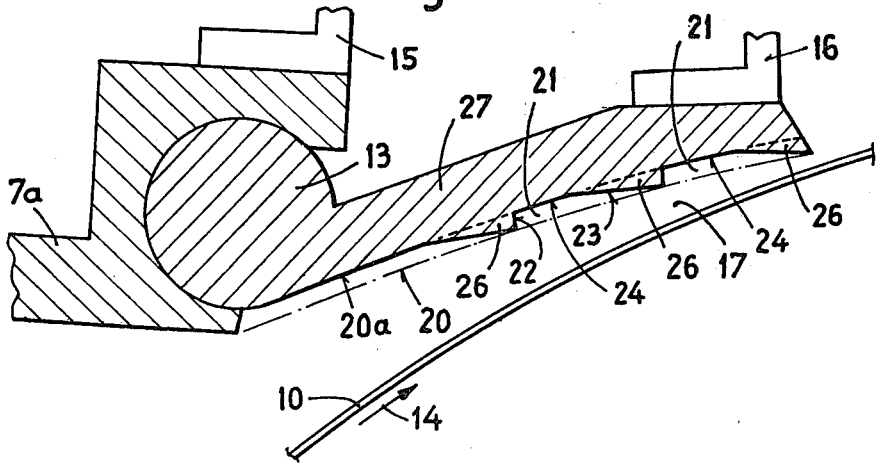
FIGS. 3, 4, 5 and 6 respectively show details of different additional embodiments of headbox construction.

FIG. 3 illustrates a lip portion 27 containing depressions or recesses 21 which are formed between raised portions or protuberances 26 of substantially triangular cross-sectional configuration. These raised portions or protuberances 26 protrude in relation to the surface portion 20*a* and the base surfaces 24. The base surfaces 24 and the surface portions 20*a* can be parts of an originally smooth inner surface of the lip portion 27 to which there have been attached the raised portions or proturberances 26, for instance in the form of appropriately configured loose ledges or the like. With this embodiment the free edges of the protuberances or raised portions 26 and an edge of the lip portion 7*a* governs the course of the guide surface 20 theoretically bounding the marginal or boundary flow.

Figure 4:
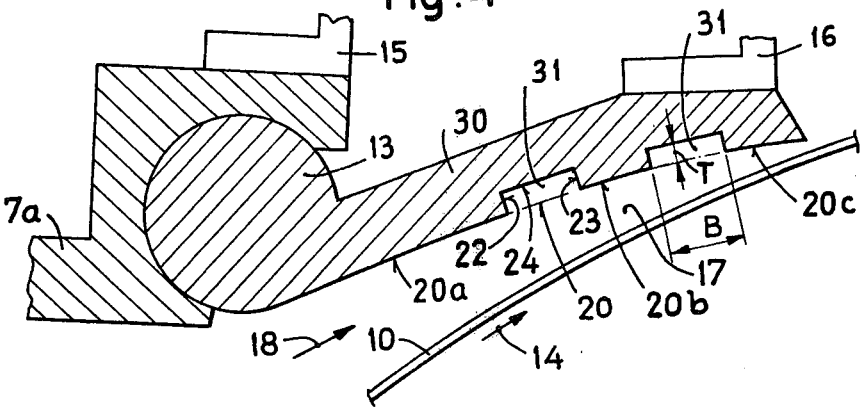

In FIG. 4 there has been illustrated a lip portion 30 containing depressions or recesses 31. Here, in each instance both flanks 22 and 23 are disposed approximately perpendicular to the related portion 20*a*, 20*b*, and 20*c*, as the case may be, of the inner surface.

Figure 5:
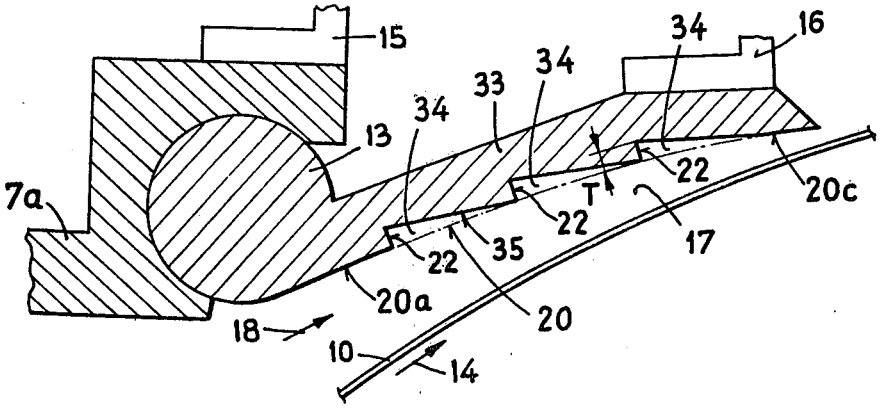

As best seen by referring to FIG. 5, it is also possible for a lip portion 33 to be used which has recesses or depressions 34 of triangular cross-sectional configuration. Each of these recesses is formed by a flow upstream flank 22 which is positioned approximately perpendicular to the guide surface 20 and a second flank 35 which merges with the first flank 22 at the downstream side thereof, and such second flank 35 in conjunction with the flank 22 of the downstream neighboring recess 34 forms an edge located at the region of the guide surface 20.

Figure 6:
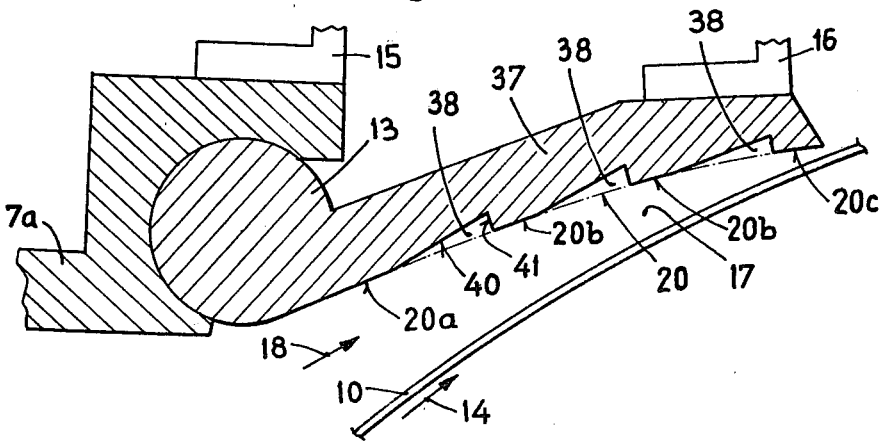

According to the modified construction shown in FIG. 6 a lip portion 37 also can be provided with substantially triangular-shaped recesses 38. Each of these recesses or depressions 38 are formed by a flank 40 extending approximately in the flow direction of the stock suspension and inclined with respect to the guide surface 20 and a flank 41 positioned transversely with respect to the flow direction of the stock suspension and directed opposite thereto. Within these recesses or depressions 38, which do not form any sudden step-like enlargement or widening of the flow cross-section, there are formed smaller recirculation turbulence than with the previously described constructions of headbox.

Figure 7:
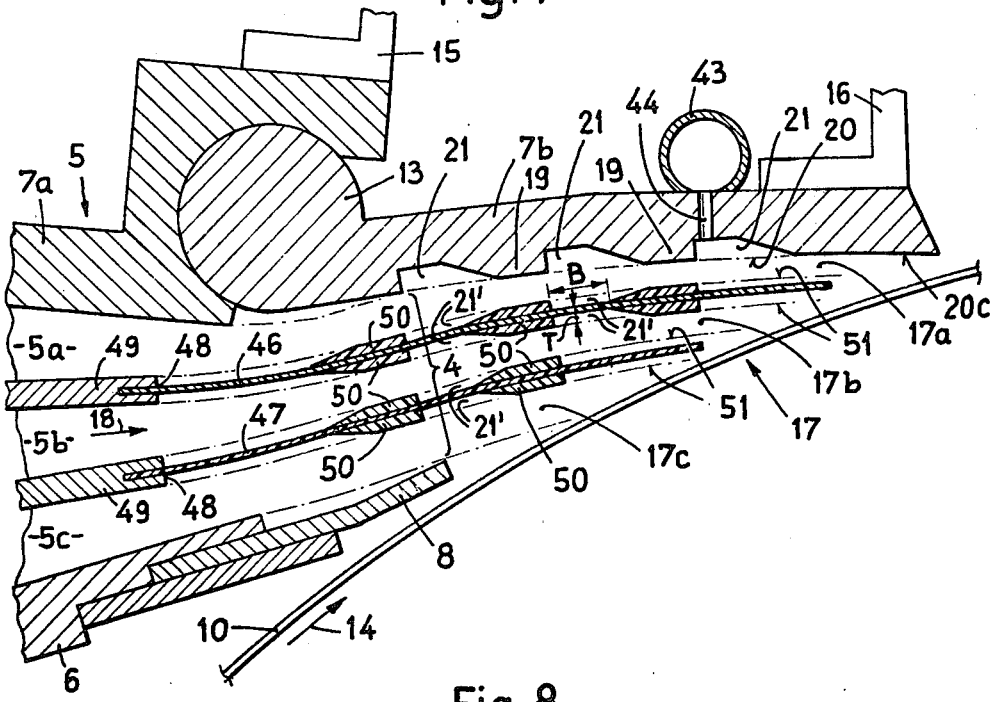
FIG. 7 is a sectional detail showing of a further embodiment of headbox.

The modified version of headbox illustrated in FIG. 7 is provided with two flexible foil-like intermediate walls 46 and 47 formed of a suitable light weight plastic material. These flexible foil-like intermediate walls 46 and 47 are arranged in the sheet forming area or chamber 17 and subdivide such sheet forming area 17 into three partial spaces or regions 17*a*, 17*b* and 17*c*. Each of the intermediate walls 46 and 47 is attached at a related holder or support 48 neighboring the outlet gap or slice 4. These holders or supports 48 are formed at the flow downstream ends of two rigid intermediate walls or partition members 49 which, in known manner, divide the nozzle channel 5 into three mutually separated converging partial channels 5*a*, 5*b* and 5*c*. Through these partial channels 5*a*, 5*b* and 5*c* and through the partial spaces or regions 17*a*, 17*b* and 17*c* it is possible to conduct different types of stock in mutually separated layers or plies until shortly prior to the sheet formation, for the purpose of fabricating a multi-ply paper. The intermediate walls 46 and 47 are here provided with three and two pairs of raised portions or protuberances 50, respectively. In the illustrated exemplary embodiment these protuberances or raised portions 50 are formed by ledge members or equivalent structure of substantially trapezoidal-like configuration in cross-section and attached to the related intermediate wall 46 and 47 at both sides or faces thereof. These trapezoidal-shaped ledge members, defining the protuberances 50, likewise are here preferably formed of a light weight plastic material.

The profiles of the raised portions 50 approximately correspond to the profiles of the raised portions 19 of the lip portion 7*b* and which separate the recesses or depressions 21 of the lip portion 7*b*. The raised portions or protuberances 50, in the illustrated exemplary embodiment, are each arranged at an approximately uniform or constant spacing from the outlet gap or slice 4 as the related neighboring raised portion 19 of the lip portion 7*b* and form together with the related intermediate wall 46 and 47, as the case may be, a respective depression or recess 21′ in relation to a theoretical guide surface 51 which is defined by the outer surfaces of the raised portions 50 extending in the flow direction. Consequently, also in the depressions or recesses 21′ there is formed recirculation turbulence, so that also in the plies of the stock suspension separated by the intermediate walls 46 and 47 there is practically eliminated the influence of the wall friction upon the flow velocity. Moreover, each of these layers or plies arrives at the surface of the wire or sieve 10 with a flow velocity which is practically constant over the entire ply or layer thickness. Hence, the thicknesses of the individual plies are solely determined by the spacing between the guide surfaces 50 and 51 and 20, respectively. The adjustment of the width of the outlet gap or slice 4 requires a lesser degree of accuracy in comparison to the heretofore known constructions of headboxes, since, for instance, a permissible deviation of 1% of the width of the slice 4 now is related to a reference or set value which has been enlarged by the thickness of the raised portions or protuberances 50.

The flexible intermediate walls 46 and 47 can optimumly regulate or adjust themselves to the flow in accordance with the course of the flow lines. To render possible a pressure compensation between the partial spaces or regions 17*a*, 17*b* and 17*c* the intermediate wall 46 and 47 also can be provided with a number of locally arranged, here not particularly shown connection openings, for instance located between the raised portions or protuberances 50. It should be understood that the intermediate walls 46 and 47 together with the raised portions 50 also can be designed as one-piece or integral structures.

Attached to the lip portion 7*b* is a connection channel 43 from which lead the bores 44 to the last recess or depression 21 located downstream with respect to the direction of flow of the stock suspension. The connection channel 43 is operatively flow connected with a here not further illustrated device for the infeed of a flow medium, for instance, air, water or a suspension liquid. By means of this connection channel 43 it is possible to influence directly prior to the sheet formation either the turbulence or, through the addition of a suitable additive, the quality of the layer or ply of the stock suspension which effluxes out of the partial space or region 17*a*.

Figure 8:
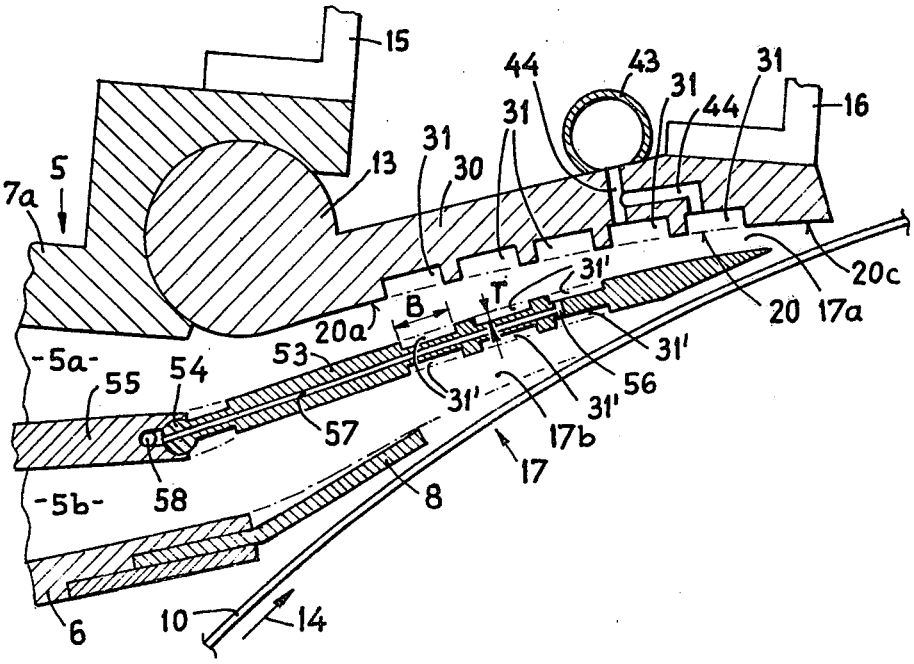
FIG. 8 is a sectional showing of a still further embodiment of headbox.

With the embodiment of headbox shown in FIG. 8 a rigid intermediate wall 53 is pivotably connected at the flow downstream end of a fixed intermediate wall 55 in order to pivot about the axis of a cylindrical portion 54.

The rigid intermediate wall 53 subdivides the sheet forming area or chamber 17 and the rigid intermediate wall 55 subdivides the nozzle channel 5. The intermediate wall 53 is equipped with groove-like recesses or depressions 31' which are situated opposite to the corresponding depressions or recesses 31 of the lip portion 30. With this embodiment the last recesses 31 located in the downstream direction of flow of the stock suspension, are connected by means of the connection channel 43 attached at the lip portion 30 with the flow medium infeed. Furthermore, the flow downstream located last recesses 31 of the intermediate wall 53 are connected by means of bores 56 and a channel 57 which piercingly extends through the intermediate wall 53 in the flow direction with a connection channel 58 which is formed in the intermediate wall 55. This connection channel 58, in known manner, likewise is flow connected with a here not further illustrated device for the infeed of a suitable flow medium. Hence, the recesses 31' either can have infed thereto the same flow medium as the recesses 31 or a different flow medium, as desired.

There are possible numerous modifications from the herein exemplary disclosed constructions of headboxes.

Thus, for instance, all of the recesses of the lip portion and/or the intermediate wall can be connected with a common or with different flow medium-infeed devices. The recesses or depressions formed at the intermediate walls additionally also can be arranged, viewed in the flow direction of the stock suspension, in offset relationship in relation to the recesses of the lip portion and/or can possess a different cross-section or other dimensions than such recesses of the lip portion. Equally, the recesses formed at the same lip portion or, as the case may be, at the same intermediate wall, can possess different dimensions, for instance can have decreasing depth T and width B in the flow direction of the stock suspension. Additionally, the flanks and base surfaces of the recesses also can merge with one another by means of a groove or fillet-like corner portion. Under circumstances and if desired it also can be sufficient to provide the lip portion or, as the case may be, an intermediate wall with a single depression or recess.

While there are shown and described present preferred embodiments of the invention, it is to be distinctly understood that the invention is not limited thereto, but may be otherwise variously embodied and practiced within the scope of the following claims. Accordingly,

What we claim is:

1. A headbox for a papermaking machine, comprising:

means defining an infeed channel for a stock suspension;

a nozzle channel bounded by two rigid lip members;

said nozzle channel merging with said infeed channel for the stock suspension in the direction of flow of the stock suspension;

means defining a substantially band-shaped dewatering surface;

a rotating water pervious cylinder over which there is guided said dewatering surface;

said nozzle channel being oriented towards said dewatering surface;

said two lip members defining a first lip and a second lip;

said first lip having an end extending in close proximity to the dewatering surface;

said second lip having a rigid lip portion protruding past the end of the first lip in the direction of flow of the stock suspension;

said rigid lip portion being provided with a guide surface which is concave with respect to the stock suspension;

said guide surface overlying a portion of the dewatering surface which neighbors in the flow downstream direction the end of the first lip and bounding with said portion of the dewatering surface a sheet forming area converging in the direction of movement of the dewatering surface;

said lip portion being provided at least at the flow downstream half of the part of its guide surface overlying the dewatering surface with at least one substantially step-like recess;

said substantially step-like recess extending essentially transversely with respect to the direction of flow of the stock suspension;

said step-like recess being formed by at least one base surface and at least one flank;

said base surface being offset with respect to the guide surface and extending in a manner essentially corresponding to the direction of flow of the stock suspension;

said flank being positioned transversely with respect to the direction of flow of the stock suspension; and said flank being positioned at least approximately perpendicular to the guide surface.

2. The headbox as defined in claim 1, wherein:

the flank of the recess is formed at a raised portion protruding from a portion of an inner surface of the lip portion which extends in the direction of flow of the stock suspension; and said raised portion protruding into the sheet forming area.

3. The headbox as defined in claims 1 or 2, wherein:

the portion of the guide surface covering the dewatering surface possesses a plurality of recesses arranged in succession in the direction of flow of the stock suspension.

4. The headbox as defined in claim 3, wherein:

said recesses comprise approximately three to twenty successively arranged recesses.

5. The headbox as defined in claim 1, wherein:

the flanks of the recesses are bounded at their side confronting the dewatering surface with edges located at the region of the guide surface.

6. The headbox as defined in claim 1, wherein:

said nozzle channel has an outlet end region defining a slice;

at least one substantially lip-like intermediate wall protruding through the slice into the sheet forming area and extending essentially in a primary direction of flow of the stock suspension; and said lip-like intermediate wall being provided at the portion located between the lip portion and the dewatering surface with at least one recess essentially corresponding in shape to a neighboring recess of the lip portion.

7. The headbox as defined in claim 6, further including:

holder means arranged neighboring said slice and to which there is attached said intermediate wall.

8. The headbox as defined in claim 1, further including:

means for infeeding a flow medium independently of a primary flow of the stock suspension; and said step-like recess being operatively connected with said flow medium-infeed means.

9. The headbox as defined in claim 1, wherein:

said recess possesses a substantially groove-like cross-sectional configuration which is formed by the base surface and two confronting flanks;

said two confronting flanks defining an upstream flank and a downstream flank; and said base surface enclosing with said upstream flank at least an approximately right angle and with said downstream flank an angle in a range of an at least approximately right angle to obtuse angle.

10. A headbox for a papermaking machine, comprising:

a nozzle channel bounded by two rigid lip members and through which flows a stock suspension in a flow direction;

means defining a movable dewatering surface;

said nozzle channel being oriented towards said dewatering surface;

said two lip members defining a first lip and a second lip;

said first lip having an end extending towards the dewatering surface;

said second lip having a rigid lip portion protruding past the end of the first lip in the direction of flow of the stock suspension;

said rigid lip portion being provided with a guide surface which is substantially concave with respect to the stock suspension;

said guide surface overlying a portion of the dewatering surface and bounding with said portion of the dewatering surface a sheet forming area converging in the direction of movement of the dewatering surface;

said lip portion being provided at least at a flow downstream portion of the part of its guide surface overlying the dewatering surface with at least one substantially step-like recess;

said substantially step-like recess extending essentially transversely with respect to the direction of flow of the stock suspension;

said step-like recess being formed by at least one base surface and at least one flank;

said base surface being offset with respect to the guide surface and extending substantially in the direction of flow of the stock suspension;

said flank being positioned transversely with respect to the direction of flow of the stock suspension; and said flank being positioned at least approximately perpendicular to the guide surface.

* * * * *